United States Patent [19]

Thompson

[11] Patent Number: 4,958,383

[45] Date of Patent: Sep. 25, 1990

[54] SNAP-ON TIE WITH SLIDER SIMULATING WINDSOR KNOT

[75] Inventor: Richard A. Thompson, Harrison, Ark.

[73] Assignee: Robert R. Keegan, Fayetteville, Ark.

[21] Appl. No.: 309,823

[22] Filed: Feb. 9, 1989

[51] Int. Cl.[5] ..... A41D 25/10

[52] U.S. Cl. ..... 2/150; 2/153

[58] Field of Search ..... 2/145, 148, 150, 152 R, 2/153, 156, 144

[56] References Cited

U.S. PATENT DOCUMENTS

| | | | |
|---|---|---|---|
| 364,017 | 5/1887 | Irwin | 2/150 |
| 407,811 | 7/1889 | Bruce | 2/150 |
| 696,363 | 3/1902 | Fleisch | 2/148 |
| 1,588,609 | 6/1926 | Palmer | 2/145 |
| 3,526,004 | 9/1970 | Brandenberger | 2/150 |

FOREIGN PATENT DOCUMENTS

| | | | |
|---|---|---|---|
| 120991 | 1/1931 | Austria | 2/150 |
| 121650 | 3/1931 | Austria | 2/150 |
| 2399221 | 4/1979 | France | 2/152 R |
| 428787 | 1/1948 | Italy | 2/150 |
| 26371 | 5/1903 | Switzerland | 2/150 |
| 710248 | 6/1954 | United Kingdom | 2/150 |

*Primary Examiner*—Peter Nerbun

[57] ABSTRACT

There is disclosed a necktie or cravat which has snaps or other fasteners allowing it to be fastened at the shirt collar or removed without tying or untying the knot. One embodiment has a strip of semi-rigid plastic several inches in length with holes which engage with standard male snap fasteners at the top ends of the two panels of the necktie. The necktie is attached and removed by snapping and unsnapping the snap fastener into a selected hole in the plastic strip. Holes spaced one-half inch apart provide adjustability to accommodate different neck sizes. Preferably the two panels of the tie are not actually knotted but are provided with a separate matching slide formed of the same material as the tie and wrapped about the panels in a manner to simulate a single windsor knot, a double windsor knot or other decorative simulated knot. In preferred embodiments, the slide portion of the tie is removably secured in a simulated single or double windsor knot by two sets of snap fasteners suitably located on the slide forming strip. Alternatively, the necktie may be snapped or otherwise fastened to mating fasteners on either side of the shirt collar provided for that purpose.

15 Claims, 3 Drawing Sheets

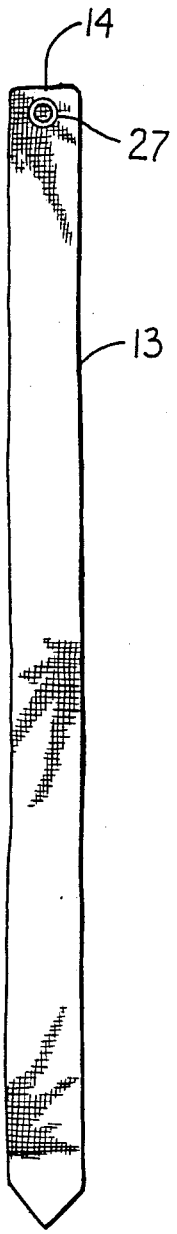
FIG. 2
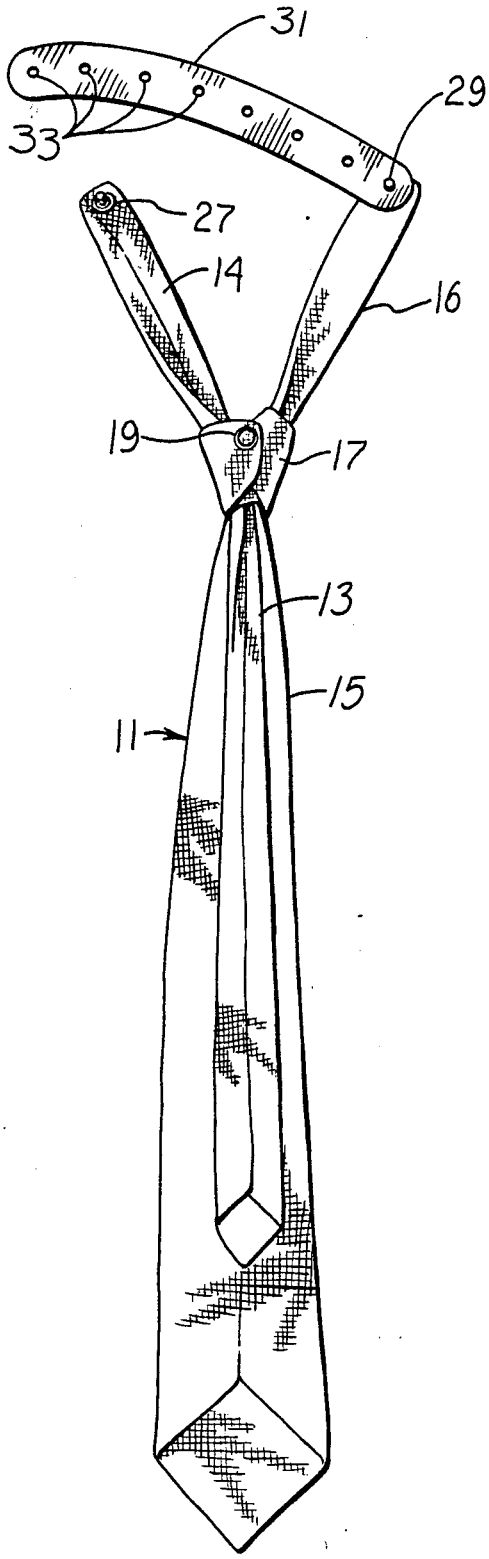
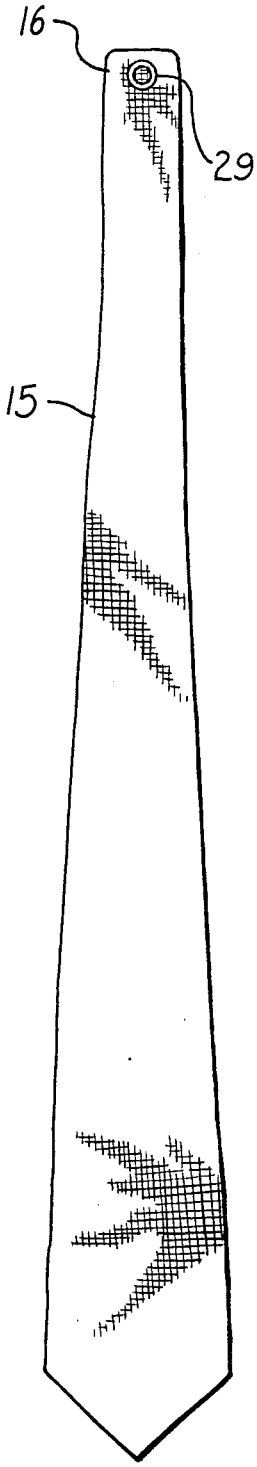
FIG. 3
FIG. 1

SNAP-ON TIE WITH SLIDER SIMULATING WINDSOR KNOT

The present invention relates to an improvement in neckties or cravats which makes the conventionally mandatory businessman's necktie more comfortable to wear and more readily removed, loosened, tightened or put on. The improved necktie of the invention is preferably attached in a readily releasable manner thus avoiding the personal safety hazard of neckties for persons in proximity to machinery.

Snap-on ties, particularly bow ties, are quite well known but the known forms of such ties are no: suitable for many purposes. The present invention primarily relates to windsor or four-in-hand ties rather than bow ties, but certain features of the invention may be applicable to bow ties as well. The invention will be discussed primarily with reference to four-in-hand ties with knots simulating windsor knots.

Previous versions of snap-on or clip-on ties have come in many variations. Clip-on bow ties are known which have clips similar to alligator clips which engage the front edges of the shirt collar and arc hidden by the outwardly extending loops of the bow tie. Other clip-on ties of the bow tie or the four-in-hand variety are provided with elastic and/or adjustable fabric strips with one strip extending from the vicinity of the bow around the back of the neck and hooking to the end of a similar strip from the opposite direction. Various ways have been provided to make such bands adjustable. Previous snap-on ties are typically permanently secured so that it is impractical or impossible to untie and retie the knot. This in turn makes it very difficult to wash or dryclean the necktie.

An even more important disadvantage of previously known snap-on ties has been the inability of the wearer to loosen the tie, particularly the four-in-hand tie, so that the shirt collar may be unbuttoned and the discomfort factor relieved in situations permitting such informality. In snap-on ties where the knot was not completely secured by stitching or the like, sliding the knot down on one panel without being loosened on the other side would cause the tie to be askew.

Representative of such prior detachable ties are those shown in the following U.S. Pat. No. 3,737,917 to John E. Orr granted June 12, 1973 (2/150); No. 3,872,513 to Beaudin, Jr. et al granted Mar. 25, 1975 (2/55); and U.S. Pat. No. 4,610,037 to Haymer granted Sept. 9, 1986 (2/145). Each of the detachable ties disclosed in the above patents is provided with a neck band having a readily releasable fastener. The patent to Beaudin, Jr. has a fastener that releases under tension for safety purposes. The patent to Orr has a knot which is premanently secured to the wide portion of the necktie but allows limited sliding movement of the narrow portion. The other patents have knots which can neither be untied nor slipped.

The present invention provides a snap-on tie which in all respects appears to be a conventionally hand-tied tie with a single windsor or a double windsor knot but wherein the simulated knot may be slid on both the narrow panel and the wide pane of the tie to loosen the tie at the throat and permit the collar to be unbuttoned and opened. It is equally simple to reverse the operation and restore the tie to the formal appearance which it is intended to present.

While it would be possible to rely on the slidability of the slider to enlarge the loop around the neck and remove the tie over the head, it is preferred to utilize a novel snap-on feature with the tie whereby it is either snapped to a plastic neckband strip or to snaps on the shirt neck under the collar.

The plastic strip of the snap-on neckband is preferably formed of semi-rigid plastic with a series of holes longitudinally spaced typically from one-quarter to one-half inch apart. The perforations of the plastic strip are readily pressed over a conventional male snap fastener and just as easily unsnapped. It is understood of course, that Velcro fasteners or other forms of detachable fastening means could be employed rather than conventional snap fasteners.

Of course, the desirability of the necktie depends to a substantial extent upon its giving the appearance of a conventional hand-tied windsor knot and the structure provided by the present invention fully accomplishes this objective.

The neckband will not be readily unsnapped unintentionally by casual movement or the like but can be unsnapped by a significant force on the necktie front portion. With the snap-on feature the tie is safe to wear either in the loosened or unloosened configuration in the presence of moving mechanical equipment since it will readily detach from the wearer's neck if caught in machinery.

In addition to providing the foregoing features and advantages it is an object of the present invention to provide a snap-on necktie wherein the tie fabric neckband portion is truncated and does not extend around the wearer's neck but each end is provided with a detachable fastener which may be secured to a mating fastening means either on the neck of the shirt under the collar or on a neckband bridging between the two truncated ends of the neckband portion of the tie.

It is another object of the present invention to provide a snap-on tie simulating a four-in-hand tie with a windsor knot including a wide panel of fabric, a narrow panel of fabric and a fabric strip which may be formed into a simulated knot around the two panels with each such panel slidable relative to the knot.

It is still another object of the present invention to provide a slider for a simulated four-in-hand necktie formed of necktie fabric in an elongated strip having two pairs of detachable fasteners located to hold the strip in place when wound about the panels of the necktie to simulate a windsor knot.

It is a still further object of the present invention to provide a plastic neckband for a snap-on necktie formed of an elongated strip of semi-rigid plastic with a plurality of longitudinally spaced holes therein of a size suitable to detachably engage a conventional or special male snap fastener of plastic or metal.

Other objects and advantages of the present invention will be apparent from consideration of the following description in conjunction with the appended drawings in which:

FIG. 1 is a snap-on four-in-hand necktie with a simulated windsor knot according to the invention;

FIG. 2 is a plan view of the narrow panel of the necktie of FIG. 1;

FIG. 3 is a plan view of the wide panel of the necktie of FIG. 1;

Figure 5:
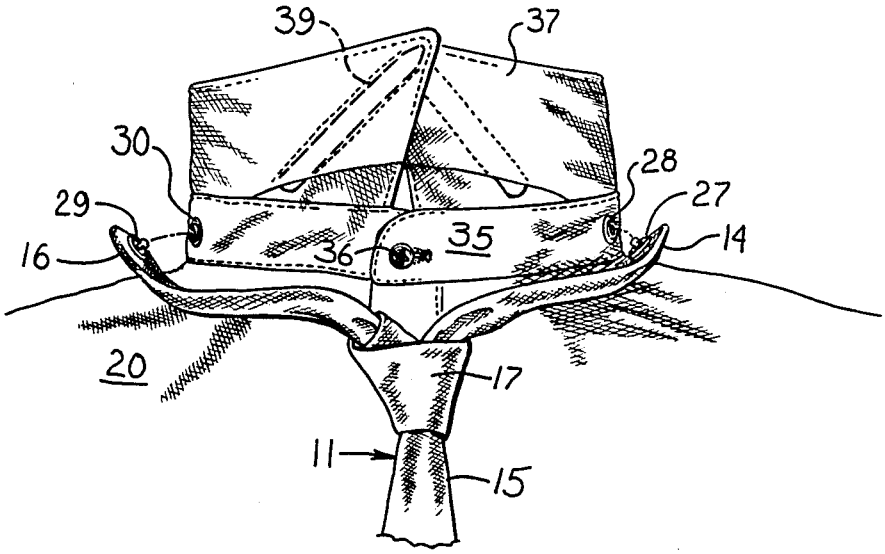
FIG. 5 is a perspective view, partially fragmentary, showing the attachment of a necktie similar to that of FIG. 1 to fasteners on the neckband of a shirt.

Referring now to the drawings and particularly FIG. 1. a snap-on necktie 11 is shown which simulates a four-in-hand tie with a windsor knot. Necktie 11 includes a wide panel 15 and a narrow panel 13 which are held together by a slider !7 simulating a single windsor knot.

The slider 17 is held in place by conventional snap fasteners one of which is shown at 19.

The upper portion 14 of narrow panel 13 has a male snap fastener 27 secured near the end thereof, and the upper portion of wide panel 15 has a male snap fastener 29 secured near the upper end thereof.

In one embodiment, the necktie is held around the neckband of the shirt with a neckband 31 of semi-rigid plastic material having a plurality of longitudinally spaced holes 33 of a size to snap onto and engage with male snap fastener 27 or 29. The neckband 31 is preferably about one-half to three-quarters inch wide and about two to six inches long and is sufficiently flexible to readily conform to the curvature of the back of the neck of the user without discomfort and being much thinner than the normal neckband portion of a conventional necktie it is less bulky and less likely to cause an unsightly bulge in the shirt collar.

Figure 4:
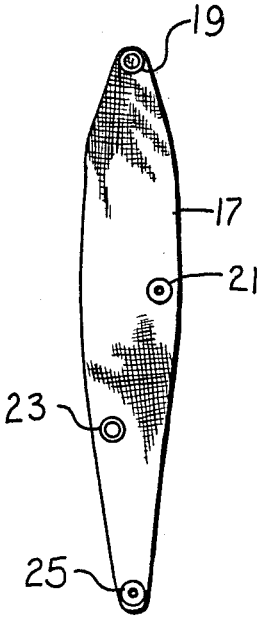
FIG. 4 is a plan view of the slidable knot portion of the necktie of FIG. 1.

FIGS. 2 and 3 show the narrow panel 13 and the wide panel 15 as they would appear before being joined with slider 17. FIG. 4 shows slider 17 in the unwrapped form where it may be seen that it is provided with a central portion extending about one inch lengthwise which is widest and which will be seen from the front of the necktie together with a narrower end at the lower portion and a somewhat wider tapered end at the upper portion. Slider 17 is preferably between three and ten inches long with a maximum width of from three-quarters to two inches.

Snap fasteners 19, 21, 23 and 25, which may be of conventional form, are arranged to facilitate the wrapping of slider 17 in a simulated single windsor knot around necktie panels 13 and 15. Fastener 25 is a male fastener facing upward, 23 is a female fastener facing downward which will mate therewith and is preferably spaced from one and one-half to two and one-half inches therefrom; fastener 21 is a male fastener facing upward and fastener 19 is a female fastener facing downward which will mate therewith and is preferably spaced from two and one-half to five inches therefrom.

FIG. 5 shows an alternative snap-on arrangement whereby the necktie 11 is generally configured as shown and described in FIG. 1 but wherein the neckband 31 is omitted. In FIG. 5 the necktie 11 is secured directly to a shirt 20 having a neckband 35 buttoned with a button 36 on which are secured female snap fasteners 28 and 30.

Figure 10:
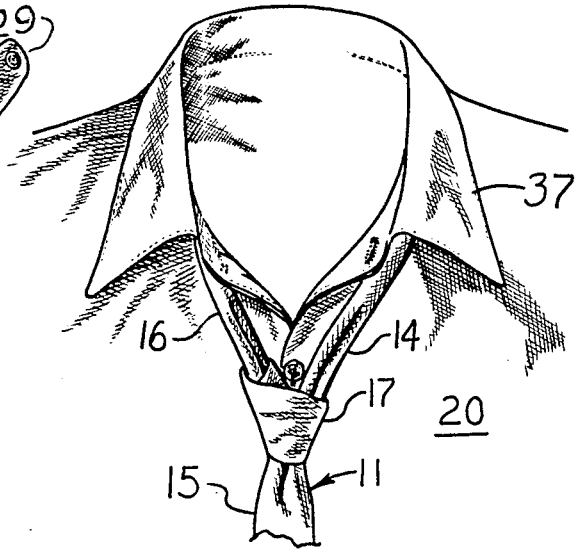
FIG. 10 is a perspective view showing the necktie of FIG. 1 or FIG. 5 moved to a loosened position while remaining secure about the wearer's neck.

Snap fasteners 27 and 29 on the upper portions 14 and 16 of panels 13 and 15 respectively may be snapped to fasteners 28 and 30 to secure the necktie 11 at the front of the collar of shirt 20. The collar 37 of shirt 20 is shown in the raised position to facilitate snapping the necktie 11 in place and, of course, would be folded down as shown in FIG. 10, for example. Collar 37 may be of any conventional form and may be provided with collar stays such as 39.

The arrangement of FIG. 5 is preferred from the point of view that no portion of the necktie is required to pass around the back of the neck of the wearer and, thus, it is quite impossible for the necktie or any portion of it to show under the back of the shirt collar or to present any distortion of the collar. The snap fasteners, such as 27. 28, 29 and 30 may be provided to the purchaser of the necktie 11 together with a simple tool to place them in the desired position on panels 13 and 15 and on the neck 35 of shirt 20. As previously explained, the neckband arrangement 31 shown in FIG. 1 can also be used and does not require snap fasteners 28 and 30 be secured to a shirt Preferably, the fasteners employed are conventional or standardized so that any mixture of neckties with shirts with or without fasteners 28 and 30 could be selected by the wearer.

Figure 6:
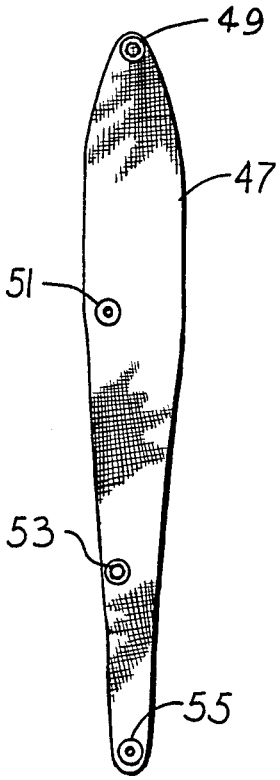
FIG. 6 is a plan view of an alternative slidable knot portion for a double windsor knot.

FIG. 6 shows an alternative embodiment for the knot simulating slider at 47. The slider 47 shown in plan view is longer to produce the simulated effect of a double windsor knot rather than a single windsor knot. It has snap fasteners 49, 51, 53 and 55 arranged somewhat differently and the additional length of slider strip 47 is primarily between fasteners 51 and 53. Fastener 55 is a male fastener facing upward, fastener 53 is a female fastener facing downward, fastener 51 is a male fastener facing upward and fastener 49 is a female fastener facing downward.

Figure 7:
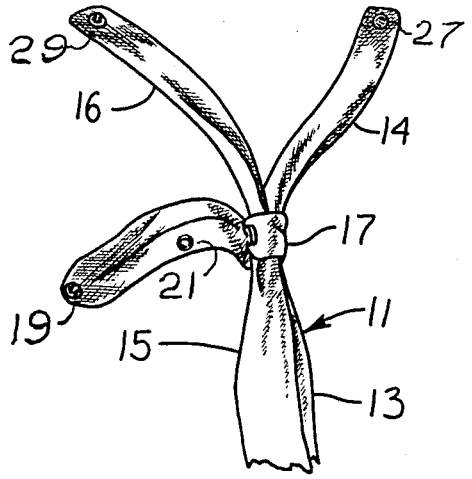
FIGS. 7, 8 and 9 are perspective views showing steps in forming the slidable knot of FIG. 5 from the slidable knot strip of FIG. 4.
Figure 8:
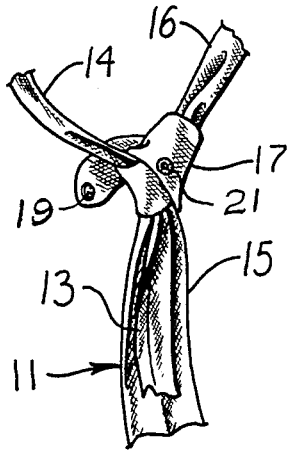
Figure 9:
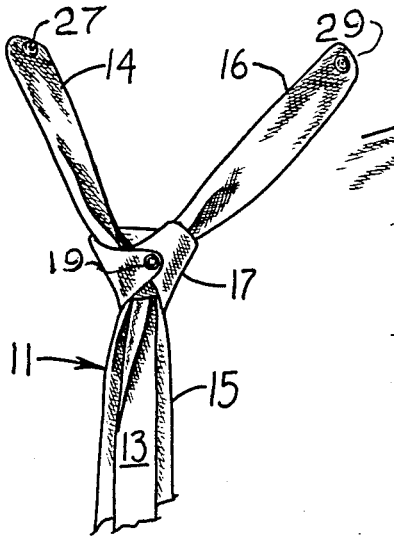

Referring now to FIGS. 7, 8 and 9, the steps for forming a simulated windsor knot in slider 17 are shown and may be described as follows. Panels 13 and 15 are put together with their top ends 14 and 16 even and wide panel 15 In front. Note that FIG. 7 shows the tie from the front while FIGS. 8 and 9 show the tie from the rear.

Slider 17 is wrapped around the two panels about six (6) inches from the top ends and snap 23 is engaged with snap 25 on the wearer's right with the loose end extending away from the wearer.

As shown in FIG. 8, the loose end with snaps 19 and 21 goes over and between upper portions 14 and 16 of panels 13 and 15 and around the wearer's right of the knot. This brings snap 17 to the back of the knot.

The loose end on the slider having snap 19 thereon continues around the front to form the most visible part of the knot, and then, as shown in FIG. 9, snap 19 snaps in place on snap 21. This finishes the knot in slider 17 with panel 13 and panel 15 each being slidable within slider 17 giving complete adjustability of knot 17.

The double windsor slider as shown in FIG. 6 will be tied in a fashion similar to that described above except that the loose end of FIG. 7 will be wrapped around the top 14 of the narrow panel 13 as well as the top 16 of the wide panel 15 before proceeding around the front and returning to snap in the back. In each case the tying of the slider conforms to the well-known manner of tying a windsor knot except that it is tied in the slider strip rather than the wide panel of the necktie. Variations are possible in the manner in which the simulated knot is tied and may be made by the wearer.

Although slider 17 has been shown and described in a configuration that permits the knot to be untied and retied for washing or cleaning, clearly the slide knot configuration could be permanently secured by stitching or otherwise rather than by detachable fasteners such as 19. 21. 23 and 25. Also fasteners of Velcro or other detachable fasteners could be substituted for the conventional snap fasteners 19, 21, 23 and 25.

It is contemplated that the necktie will be packaged and sold in an assembled form as shown in FIG. 1, for example, so that the purchaser need never tie a knot. At the same time, when detachable fasteners are used the purchaser is given the option of wrapping and unwrapping the slider 17 to facilitate cleaning the tie if he or she so desires.

FIG. 10 shows the necktie 11 with a slider 17 in a downward position allowing the collar 37 of shirt 20 to be open at the neck for comfort or convenience of the wearer. It will be noted that the slider 17 is not skewed to one side as it would be in a conventional tie where the knot was formed in one of the tie panels. The free slider 17 on panels 13 and 15 also makes it quite easy to restore the slider to the upward position giving the formal or business-like appearance of a dress shirt with four-in-hand necktie.

In addition to the variations and modifications to the invention shown, described or suggested above, other variations or modifications will be apparent to those skilled in the art; and accordingly the scope of the invention is not to be considered limited to those embodiments described or suggested, but is rather to be determined by reference to the appended claims.

I claim:

1. A snap-on necktie comprising a first elongated panel of necktie fabric material, a second elongated panel of necktie fabric material having a width no greater than said first elongated panel, said first and second elongated panels being joined together near respective ends thereof, a thin flexible sheet of plastic about one-half to three-quarters inch wide and about two to six inches long at least temporarily attached to one of said elongated panels at one of said respective ends, and a male snap fastener secured on the other of said elongated panels near an end thereof, said sheet of plastic having at least one hole therein mating with said male snap fastener, whereby elongated panels of necktie fabric material joined near one end may be secured around the neck collar of the wearer and linked by said flexible sheet of plastic.

2. Apparatus as recited in claim 1 wherein said at least one hole comprises at least three holes spaced not more than about one-half inch apart.

3. Apparatus as recited in claim 1 further including a simulation of a windsor knot at a juncture of said first and second elongated panels comprising a further flexible flat strip of fabric material between three and ten inches long and with a maximum width of from three-quarters inch to two inches, said strip having a wide portion of about its maximum width extending for at least one inch along the length of said strip, said further flexible flat strip being arranged around the first and second elongated panels in simulation of a windsor knot and secured by joining said second fastener to said first fastener.

4. A necktie for simulating a windsor knot comprising a first portion of necktie material, a second portion of necktie material, means for fastening said first and second portions together at the neck of a wearer, a flexible flat strip of material between three and ten inches long and with a maximum width of from three-quarters inch to two inches, a first fastener secured on said strip near an end thereof, a second fastener forming a fastener pair with said first fastener secured on said strip, a third fastener near an end of said strip, and a fourth fastener forming a fastener pair with said third fastener secured on said strip, said fourth fastener being offset from the center of the width of the strip, whereby said flexible flat strip may be arranged around said portions of necktie material in simulation of a windsor knot and secured by joining said second fastener to said first fastener and joining said fourth fastener to said third fastener.

5. Apparatus as recited in claim 4 wherein said first and second portions of necktie material are separate and are provided with respective fasteners near ends thereof.

6. Apparatus as recited in claim 4 wherein said third and fourth fasteners face toward opposite faces of said strip causing an overlapping loop to be formed in said strip when said third and fourth fasteners are joined.

7. Apparatus as recited in claim 4 wherein said fasteners are snap fasteners.

8. Apparatus as recited in claim 5 wherein said fasteners are snap fasteners.

9. Apparatus as recited in claim 6 wherein said fasteners are snap fasteners.

10. A slide for a necktie simulating a windsor knot comprising a flexible flat strip of material between three and ten inches long and with a maximum width of from three-quarters inch to two inches, said strip having a first and a second end and having a wide portion of about its maximum width extending for at least one inch along the length of said strip, a first fastener secured on said strip near said second end, a second fastener forming a fastener pair with said first fastener secured on said strip about one and one-half inches to two and one-half inches from said first fastener, a third fastener near said first end of said strip, a fourth fastener forming a fastener pair with said third fastener secured on said strip about two and one-half inches to five inches from said third fastener, said fourth fastener being offset from the center of the width of the strip, whereby said slide may be arranged around strip portions of necktie material in simulation of a windsor knot and secured by joining said fastener to said first fastener and joining said fourth fastener to said third fastener.

11. Apparatus as recited in claim 10 wherein said first and second fasteners face toward opposite faces of said strip thereby causing an overlapping loop to be formed in said strip when said first and second fasteners are joined.

12. Apparatus as recited in claim 11 wherein said fasteners are snap fasteners.

13. Apparatus as recited in claim 1 wherein said at least one hole comprises at least three holes spaced apart longitudinally by at least one quarter inch.

14. Apparatus as recited in claim 13 wherein said sheet of plastic is semi-rigid and said holes are of a size to engage a conventional metal snap fastener.

15. Apparatus as recited in claim 1 wherein said sheet of plastic is semi-rigid and said at least one hole comprises at least five holes spaced longitudinally at least one-quarter inch apart.

* * * * *